US007530611B2

(12) United States Patent
Liang et al.

(10) Patent No.: US 7,530,611 B2
(45) Date of Patent: May 12, 2009

(54) NIGHT LATCH FOR SLIDING MEMBER

(75) Inventors: Luke Liang, South Plainfield, NJ (US); Toni Liang, Guangzhou (CN); David Chen, Guangzhou (CN)

(73) Assignee: Vision Industry Group, So. Plainfield, NJ (US)

( * ) Notice: Subject to any disclaimer, the term of this patent is extended or adjusted under 35 U.S.C. 154(b) by 222 days.

(21) Appl. No.: 11/390,467

(22) Filed: Mar. 28, 2006

(65) Prior Publication Data

US 2007/0246953 A1 Oct. 25, 2007

(51) Int. Cl.
*E05C 17/44* (2006.01)

(52) U.S. Cl. ..... 292/338

(58) Field of Classification Search ..... 292/338, 292/63, DIG. 47, 339, DIG. 31, DIG. 20; 49/449

See application file for complete search history.

(56) References Cited

U.S. PATENT DOCUMENTS 5,248,174 A * 9/1993 Matz et al. ..... 292/338
5,489,131 A * 2/1996 Blom ..... 292/101
5,536,052 A * 7/1996 Maier ..... 292/63

* cited by examiner

*Primary Examiner*—Patricia Engle
*Assistant Examiner*—Mark Williams
(74) *Attorney, Agent, or Firm*—Thomas A O'Rourke; Bodner & O'Rourke LLP

(57) ABSTRACT

The present invention relates to a night stop that includes a housing, tumbler, spring, and a right arcuate nest, located on the inside bottom surface of the housing, used for maintaining the bottom rounded portion of the spring. The tumbler of the present invention has a top rear surface that is used as a button for activating the tumbler. In addition, the tumbler of the present invention has a concave rear bottom portion that contacts a stopping member when the tumbler is in an activated position. The spring of the present invention is partially housed inside of a bored cavity located on the tumbler. The bottom rounded portion of the spring is maintained in an arcuate nesting area when the tumbler is deactivated. When the tumbler is activated the bottom rounded spring portion traverses over and across a divide point into a right recession area.

25 Claims, 20 Drawing Sheets

10

16
13
14
25
19
28
24
35
20
23
34
Pat. Pend.
29
17
51
18

NIGHT LATCH FOR SLIDING MEMBER

FIELD OF THE INVENTION

The present invention is directed to the field of window hardware, particularly window hardware for double hung windows.

BACKGROUND OF THE INVENTION

Double hung windows are a common type of window used in many homes and remodeling. There is a frame with a pair of tracks on each side of the frame. There is a top sash and a bottom sash. The top sash typically rides in the outer tracks, i.e. the tracks in the frame closest to the outside of a building. The lower sash rides in the inner track, i.e. that track that is closest to the interior of a house. The sash has a pair of vertical stiles that are joined to upper and lower horizontal styles. One or more panes of glass are retained in the sash. There can be an inner pane and an outer pane that extends from one vertical stile to the other and from one horizontal stile style to the other. There can be a third pane of glass positioned similarly with a gap between the first and second panes. The gap is usually filled with an inert gas such as argon. This structure provides a window with insulating qualities. One or more muntin bars can be present to provide a look of individual grids in the window of the type that are found in older construction.

In many double hung windows there is an issue of security. There is usually an outer screen that permits cooler air to ventilate into the house during the warmer months. In order to take advantage of the screen however, the bottom pane typically must be in a raised position. Double hung windows are usually provided with a sash lock that locks the lower and upper sash in position so that they cannot be opened from the outside. While this provides some security during the cooler months, the return of warn weather may make it difficult to use the sash lock in many instances. The sash lock has two positions, a locked position and an unlocked position. Thus the resident has a choice to either keep the window in a closed locked position or have the window sash unlocked and thus open to intruders.

In order to provide a means of ventilating a room yet provide some security, there have been a number of night latches and vent stops that have become available in the market. One such sash stop is U.S. Pat. No. 5,248,174 owned by Ashland Products. Another type of sash stop U.S. Pat. No. 4,923,230, owned by Ro Mai. These night latches or vent stops act in a similar fashion. The night latch or vent stop is placed in the face of the upper sash. Depending on the desired amount of ventilation, the night latch can be placed at any position on the face. Once the night latch is secured in the face of the window, the tumbler can be pressed in an inward and upward fashion activating a spring mechanism that will force the tumbler to an exposed position, thus creating the impeding force required to restrict movement of the lower window sash. Other prior art vent stops are U.S. Pat. Nos. 5,553,903 and 5,806,900 both of which are owned by Ashland.

As mentioned previously, the typical prior art vent stop prevented the opening of the lower sash in similar fashions. In the typical prior art the tumbler was held in a locked position via a catch portion located in the housing of the night latch. Thus, if inwardly and upwardly forces were applied perpendicularly to the face of the tumbler, these forces would release the tumbler from its locked, inactivated position, to its unlocked, activated position.

While the tumblers in the prior art night latches are capable of preventing the sliding member from moving passed a certain predetermined position, these tumblers have an unfavorable characteristic. That is in the prior art vent stop, in order for the user to free the tumbler from its inactivated position to its activated position or vice versa. The user must apply a multitude of forces in a variety of different angles.

Although the night latch and/or vent stops are capable of preventing the lower sash from moving passed a certain desired position, their utility is unfortunately outweighed by their inherent clumsy composition. The night latch in the present invention improves on the prior art shortcomings by implementing a unique method of activating and inactivating the tumbler from the housing, without taking away from its utility and its aesthetic quality.

OBJECTS OF THE INVENTION

It is an object of the present invention to provide a night latch that operates more easily than the prior art night latches.

It is an object of the present invention to provide a night latch that is more wind tight than the prior art night latches.

It is an object of the present invention to provide a night latch that is simpler and more compact in its housing than the prior art night latches.

It is an object of the present invention to provide a night latch that is compatible with more frames with different configuration.

It is an object of the present invention to provide an improved night latch that is more reliable in its strength and operation than the prior night latches.

It is an object of the present invention to provide a night latch that allows the user to more readily reposition the tumbler back in an inactivated position.

It is still another object of the invention to allow the user the ability of activating the tumbler without the use of multiple forces to release the tumbler.

It is a still further object of the present invention to provide for a more durable night latch, so as to allow for a longer period of operability.

SUMMARY OF THE INVENTION

The present invention is an improved night latch or sash controlling mechanism. The improved night latch can be used with a variety of windows and doors, including but not limited to, single hung windows, double hung windows, sliding windows and doors, etc. The windows can be of the type that moves vertically or horizontally. If the windows are to move in a vertical fashion then the window will have upper and lower sashes situated in the frame of the window. If the windows are to move horizontally, then the windows will have right and left sashes situated in the window frame. A night latch for a sliding door can be installed and operated in the same manner as the sliding window, except the doors will sit in the doorframe rather than a window frame. More specifically, this invention is directed to be an integral part of a sliding window or door that is simple, inexpensive, and ergonomically superior to the prior art.

In the present invention the night latch has three primary components a tumbler, button, and a housing that will accommodate the tumbler and the button. The housing is placed in a groove or recess on the face of the upper window sash. The housing is constructed so as to make for a tight, smooth, and finished appearance when inserted into the groove of the window sash. This fit will make for an aesthetically pleasing appearance. Furthermore, the housing is designed for more compatibility of different configuration sash frames.

As in the prior art, a tumbler is generally used as the stopping mechanism in the night latch. In general, the tumblers are activated by applying an outside force in a multitude of ways directly to the tumbler, making for a rather difficult and sometimes impossible task. One example of this is when the spring inside the tumbler is new and rather tight. In the present invention the tumbler is activated via an active twofold spring, which is partially located in the cavity of the tumbler, of the night latch, and with the end in the inner bottom surface of the housing of the night latch. This allows the user to activate the tumbler with relative ease. The force applied can be in a downward motion, as in the present invention, or the force applied can be in an inward motion. The direction of the force applied depends on how the button is configured.

In addition to the relative ease of operation of the improved night latch, the improved night latch has a stronger and more wind tight housing that is relatively sealed and can accommodate all parts inside. In the prior art the housing is open, thus exposing the inside parts, such as the tumbler and spring, to the outside weathering elements, such as moisture in the air, which could cause malfunction of the night latch, i.e. rusty spring. In present invention the closed housing acts as a barrier, so as to impede the destructive nature of weathering and moisture in the air.

Furthermore, the night latch has a unique twofold spring in the housing that can be deactivated with even less effort than the prior art. If the user wished to close the night latch in the prior art, the user would have to exert an inward and downward force to deactivate the night latch. This is because the tumbler in the prior art is kept depressed via the face of the tumbler and the top plate of the housing. As mentioned previously application of these forces can prove to be rather burdensome when the night latch was fairly new. In the present improved night latch, the only force needed is a downward force, or inward force, this is because of the co-action between the rounded bottom portion of the spring and the nesting area of the bottom surface of the housing.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
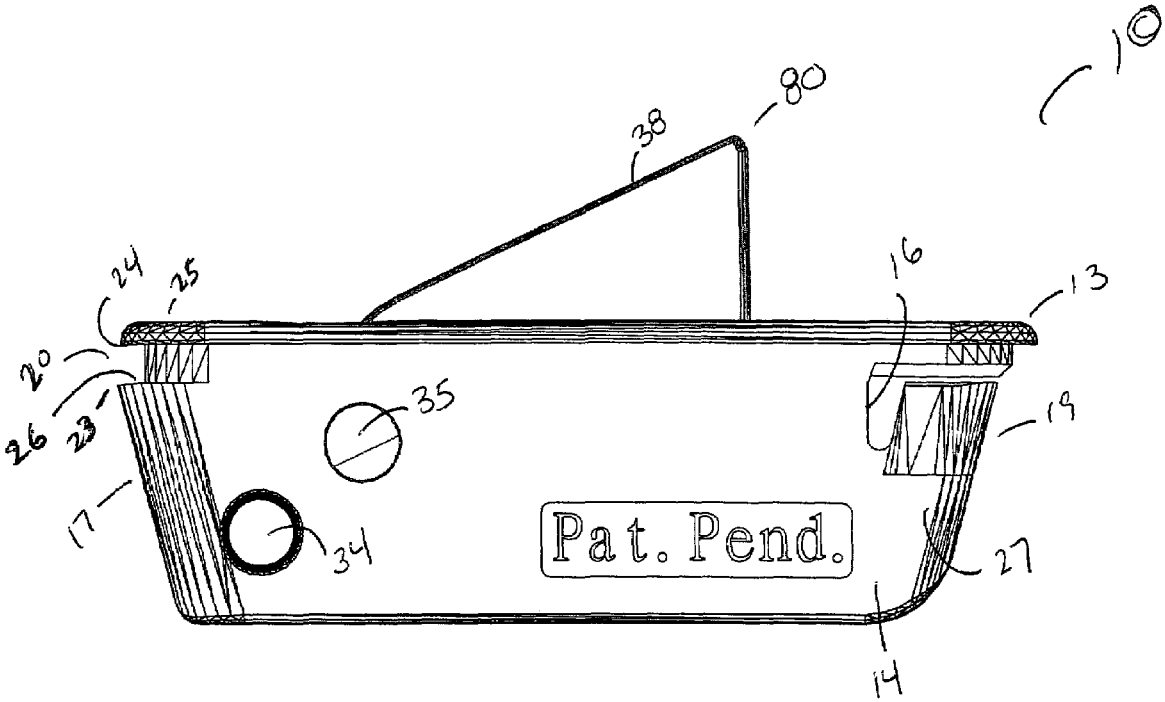
FIG. 1 is a side view of the tumbler and spring, with spring inside of cavity of tumbler, with tumbler exposed of the present invention.
Figure 8:
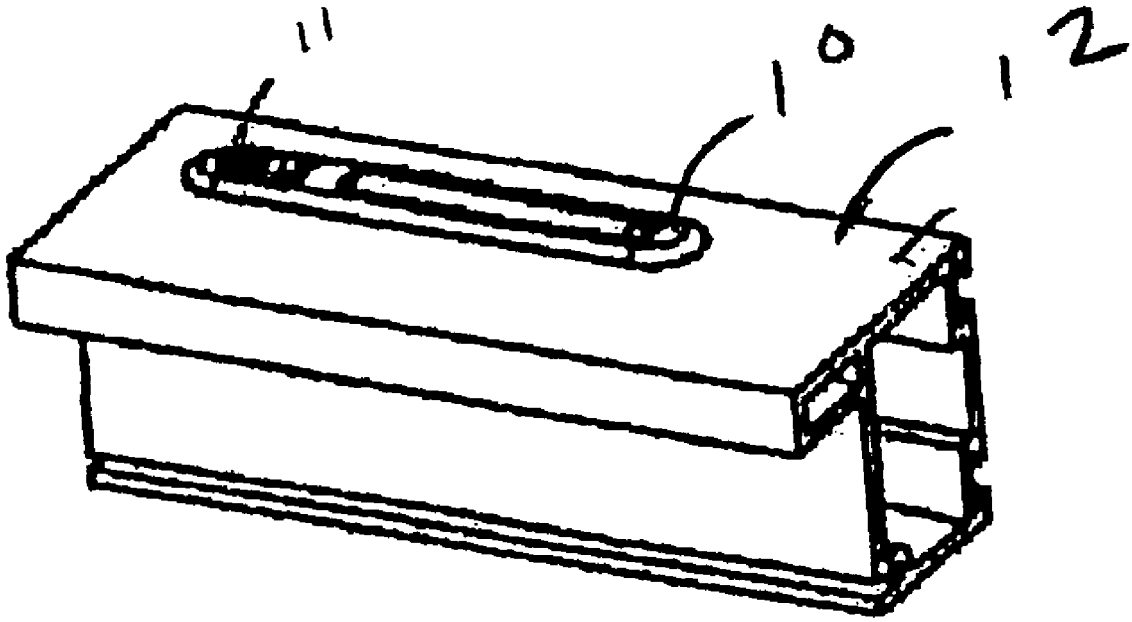
FIG. 8 is a perspective view of the night latch secured in the stopping member, of the present invention.
Figure 9:
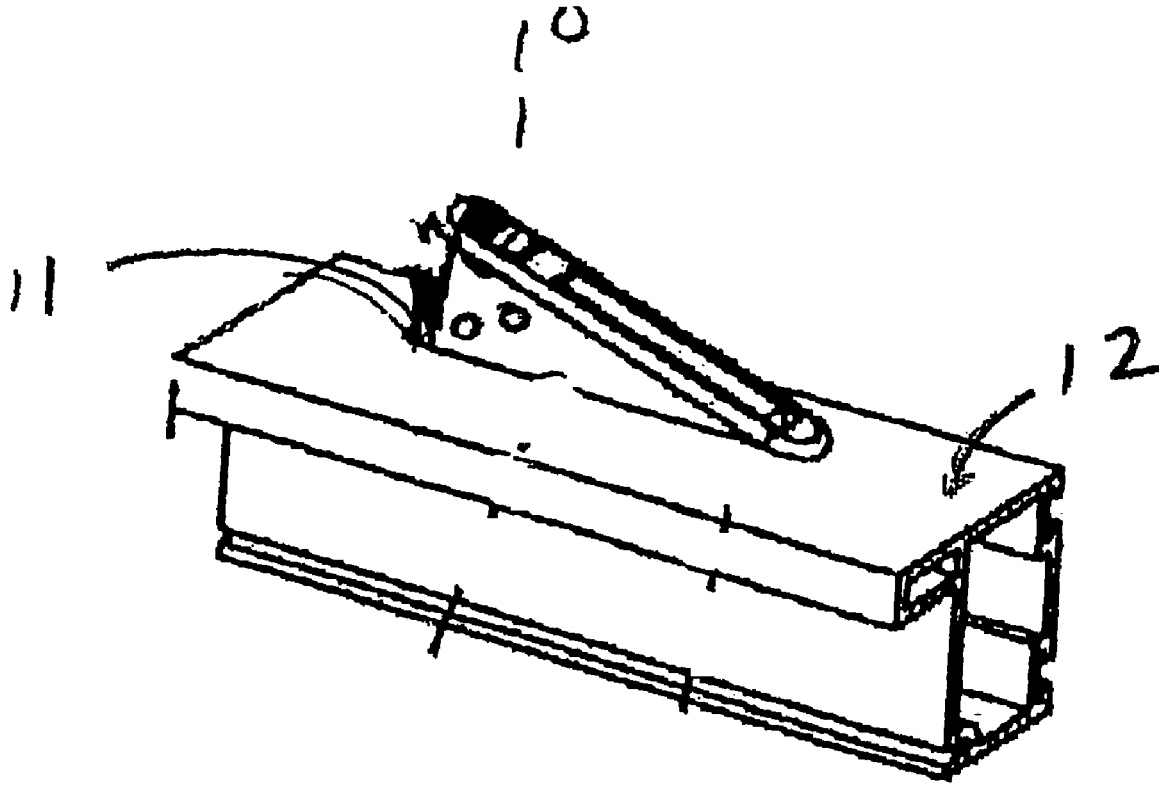
FIG. 9 is an exploded view of night latch and stopping member, of the present invention.
Figure 10:
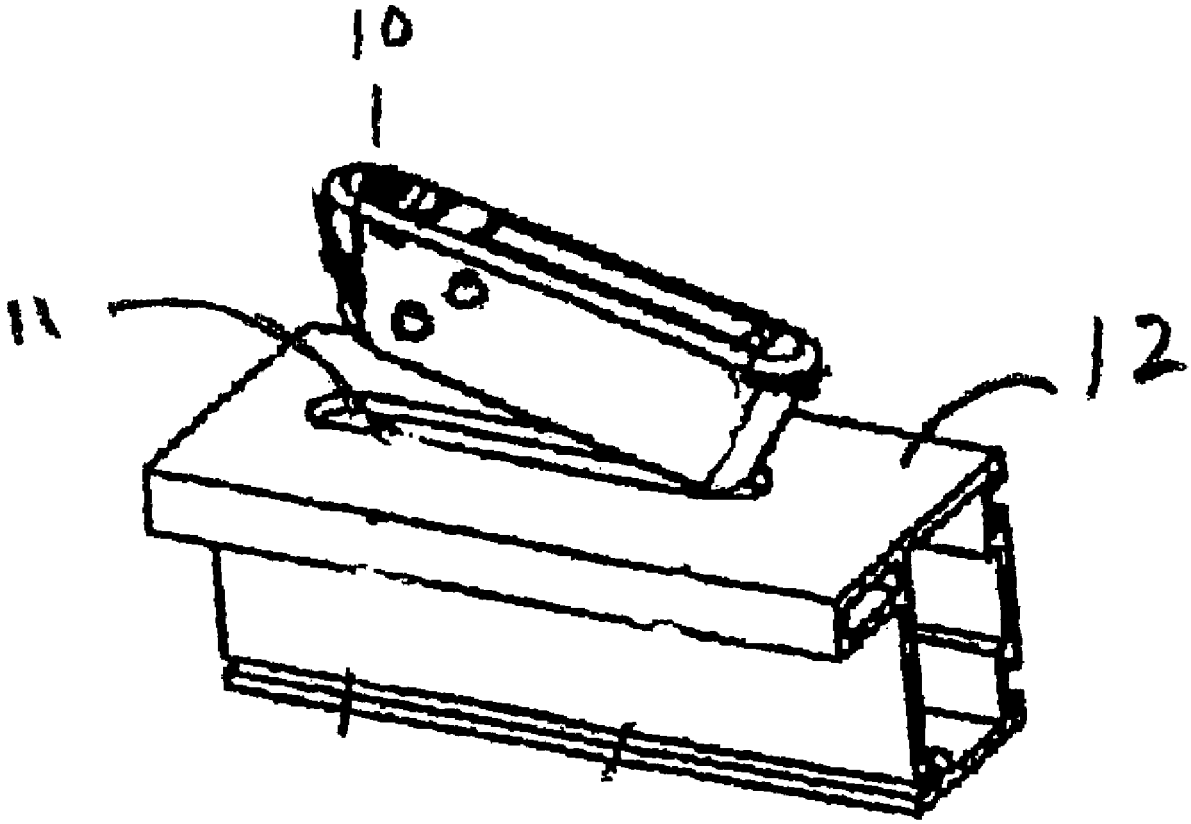
FIG. 10 is an exploded view of the night latch, stopping member, and oval opening on stopping member, of the present invention.

In FIG. 1 the night latch of the present invention is shown generally at 10. The night latch 10 is shown positioned over slot 11 in sliding member 12 as seen in FIGS. 9 and 10. The slot 11 is shown as having an oval shape, but any other suitable shape and size slots including but not limited to a square, rectangle, oval, etc. can be used depending on the shape of the latch. Preferably, however, the night latch 10 of the present invention will have a portion similarly shaped to the slot 11 as to present a clean appearance when placed in the stopping member 12, as seen in FIG. 8. In the present embodiment an oval shape for illustration purposes was used. The stopping member can be a sash, doorframe, or any other member that has another piece sliding over it, where restriction of the sliding member is desired. The tumbler 80 can be either in a raised or lowered position. When raised it prevents movement of the door or sash, as seen in FIG. 1.

Figure 6:
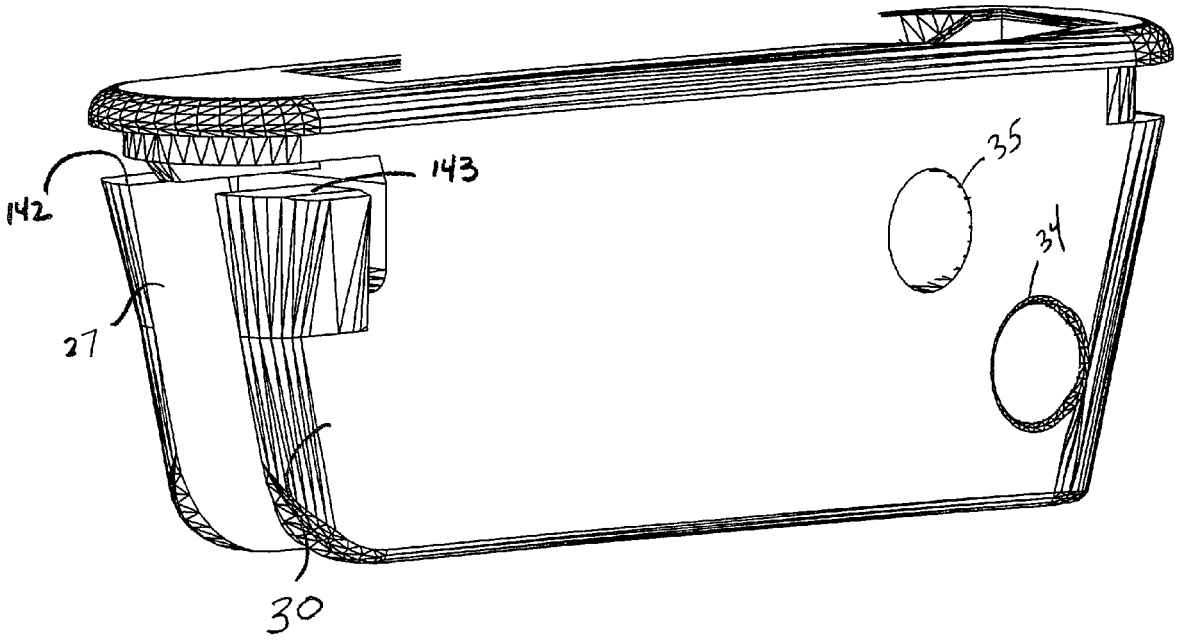
FIG. 6 is a perspective view of tumbler of the present invention.
Figure 7:
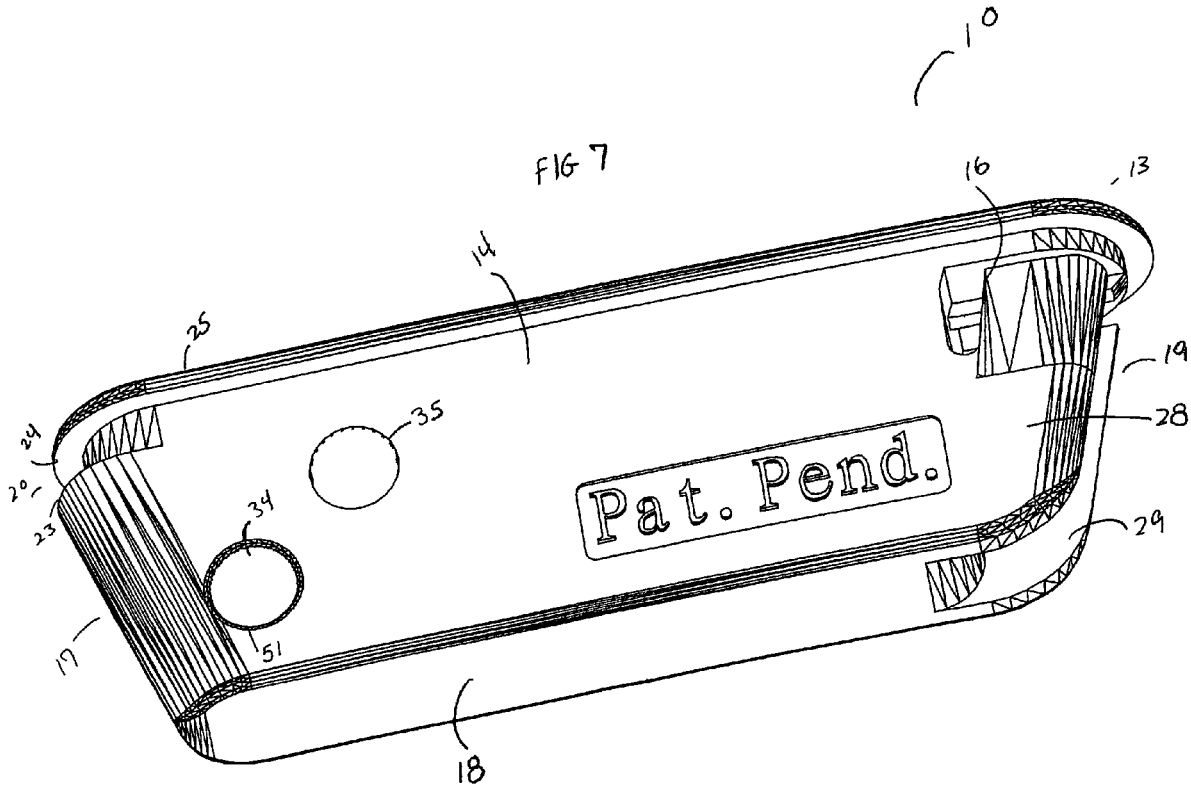
FIG. 7 is a side view of night latch of the present invention.
Figure 15:
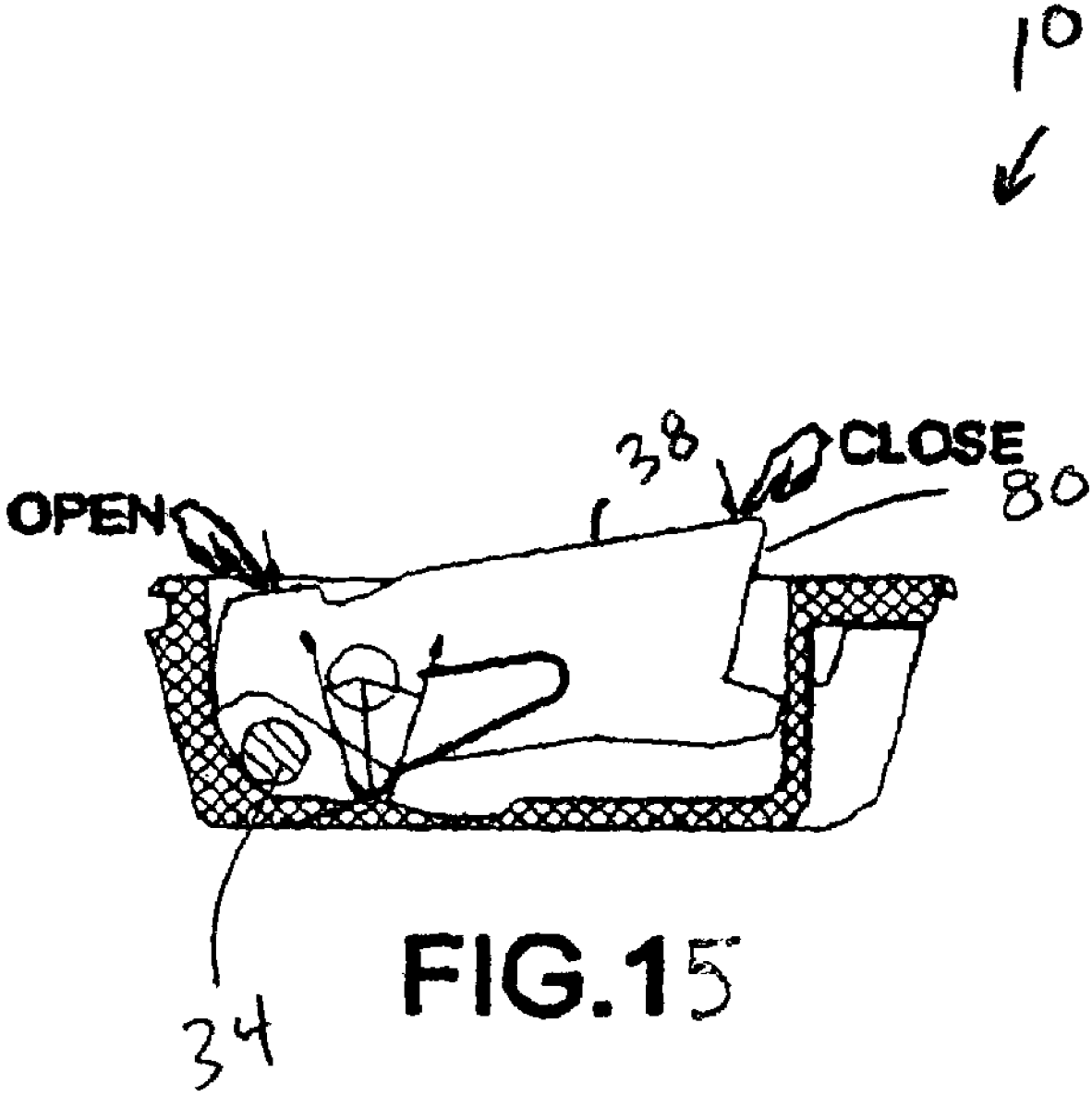
FIG. 15 is a side cross sectional view of the night stop of the present invention, with different forces being applied to the tumbler.

A housing 13 is generally defined by a first sidewall 14, and a second sidewall 15, not shown, and a front wall 16, and a rear wall 17, not shown, and a bottom wall 18, as shown in FIG. 7. Bottom wall 18 can also serve as a cover. In the present embodiment however bottom wall 18 is sealed, and no cover is present. It is noted that the terms "front" and "rear" are used only for descriptive purposes and do not read on orientation of the device. Sidewalls 14, as seen in FIG. 1 and 15, not shown, are preferably the same length, as are front and rear walls 16 and 17, respectively, providing for a generally rectangular shape to housing 13. Preferably, when in place within slot 11, sidewalls 14 and 15 contact the edges of slot 11 to provide for a tight fit, and prevent a lateral movement of the night latch 10 within slot 11. Front wall 16 can have a front flexible clip 19 and rear wall 17 can have a rear flexible clip. In the present embodiment there is only one flexible clip, front flexible clip 19, as seen in FIG. 1. Rather then use a rear clip; one can use a rear notch 20 to produce the same fastening effect as a rear clip, as seen in FIG. 1. The rear notch 20 is of non flexible nature, it is located at the end of the housing 13; it is created between a surface 26, which runs parallel to lip 23, and the bottom surface 24 of the top plate 25. Front flexible clip 19 can extend generally in an upward fashion, originating at or near the bottom surface 21 of housing 13 and ending typically just below top plate 25, as seen in FIG. 1. In addition, flexible clip 19 may be solid or hollow. In the present embodiment flexible clip 19 is comprised of two generally rectangular protrusions, so as to resemble two teeth, tooth one 140 and tooth two 141, as seen in FIG. 6, located on sidewalls 14 and 15. Tooth one 140 has inner and outer surfaces 27, as seen in FIGS. 6 and 28, as seen in FIG. 7, located adjacent to sidewall 14. Tooth two 141 has inner and outer surfaces 29, as seen in FIGS. 7, and 30, as seen in FIG. 6, located adjacent to sidewall 15. Flexible clip 19 may be affixed to front wall 16 or flexible clip 19 may be an integral part of housing 13, in the present embodiment flexible clip 19 is an integral 19 part of housing 13. In addition, flexible clip 19 has top surfaces 142 and 143, located on teeth 140 and 141 respectively.

Figure 14:
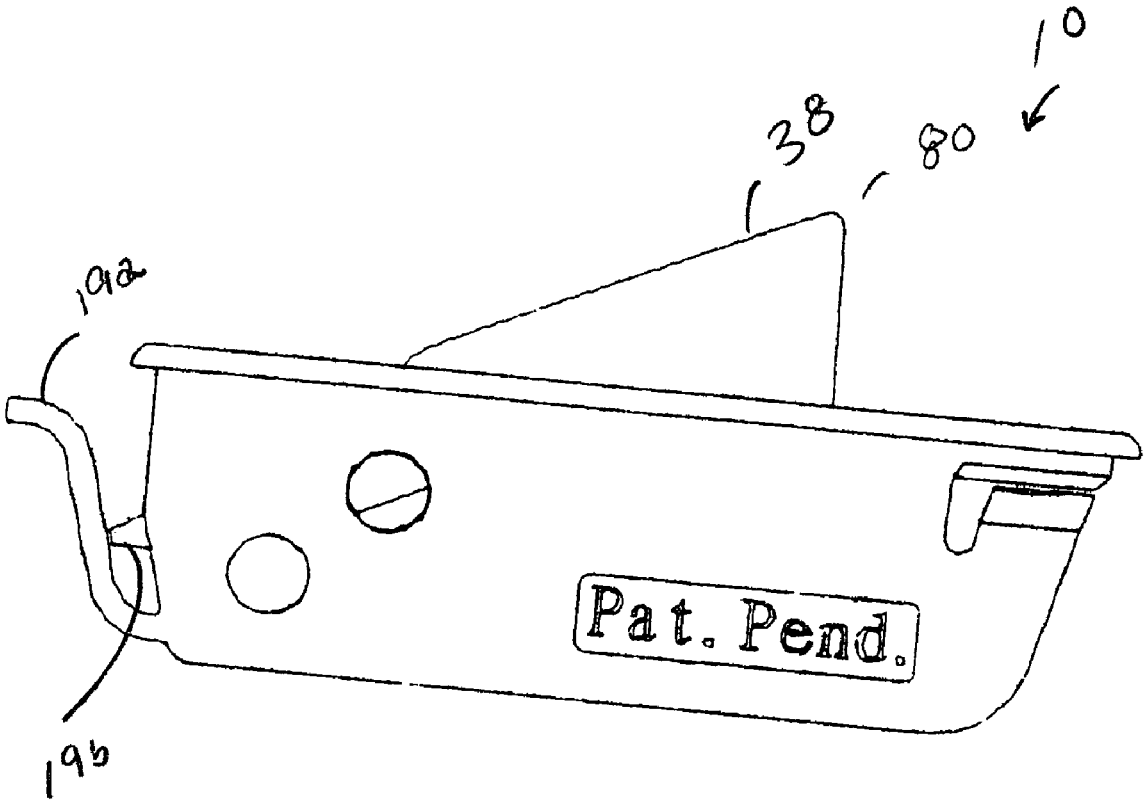
FIG. 14 is a side view of the night stop of the present invention, with a different flexible clip, with the tumbler exposed.
Figure 17:
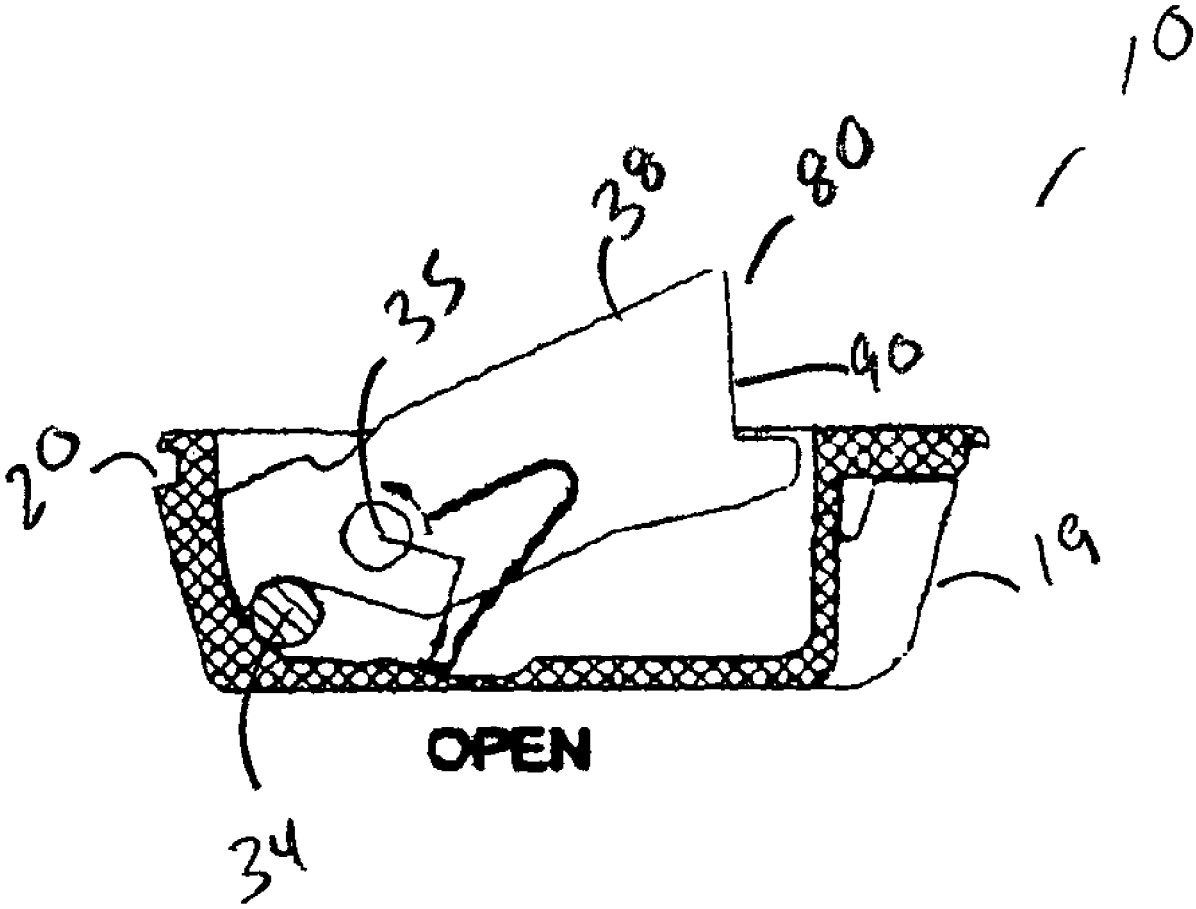
FIG. 17 is a cross sectional view of the night stop of the present invention, with the tumbler in an activated position.
Figure 18:
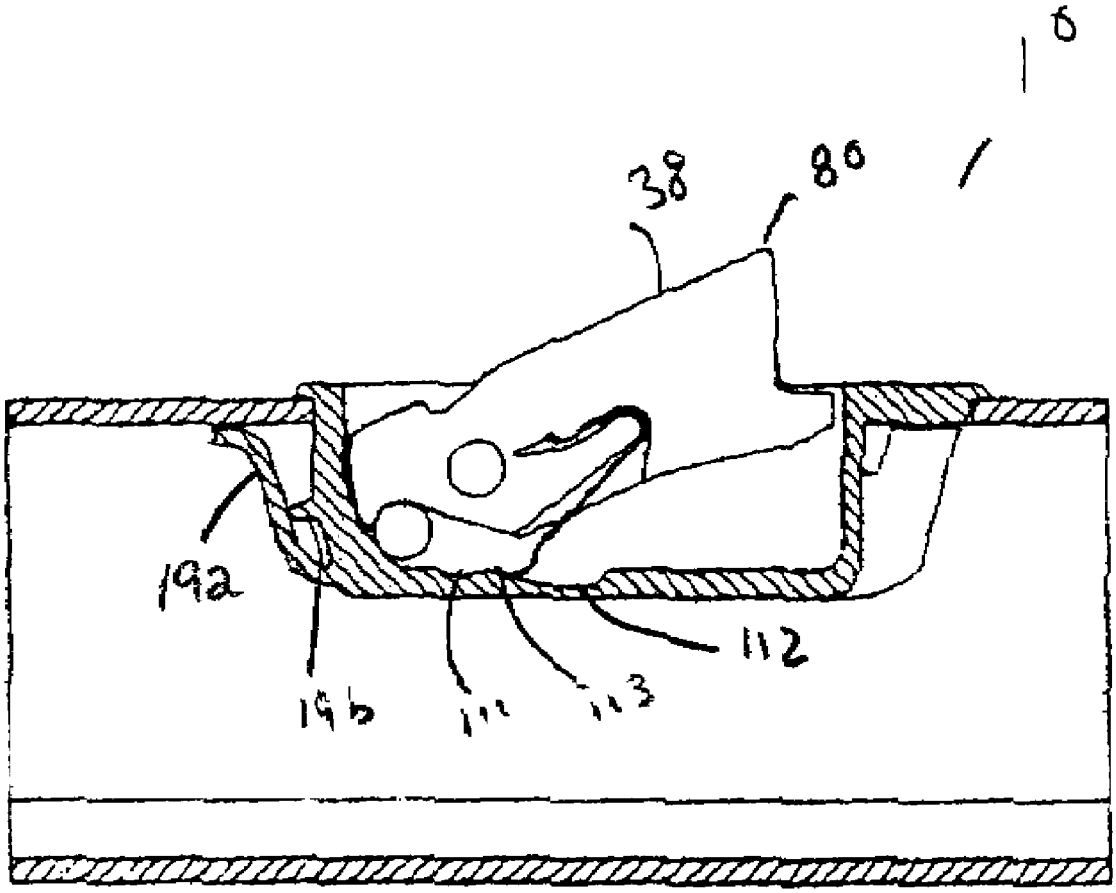
FIG. 18 is a side view of the night stop, of FIG. 14, set inside a different style of window frame.
Figure 19:
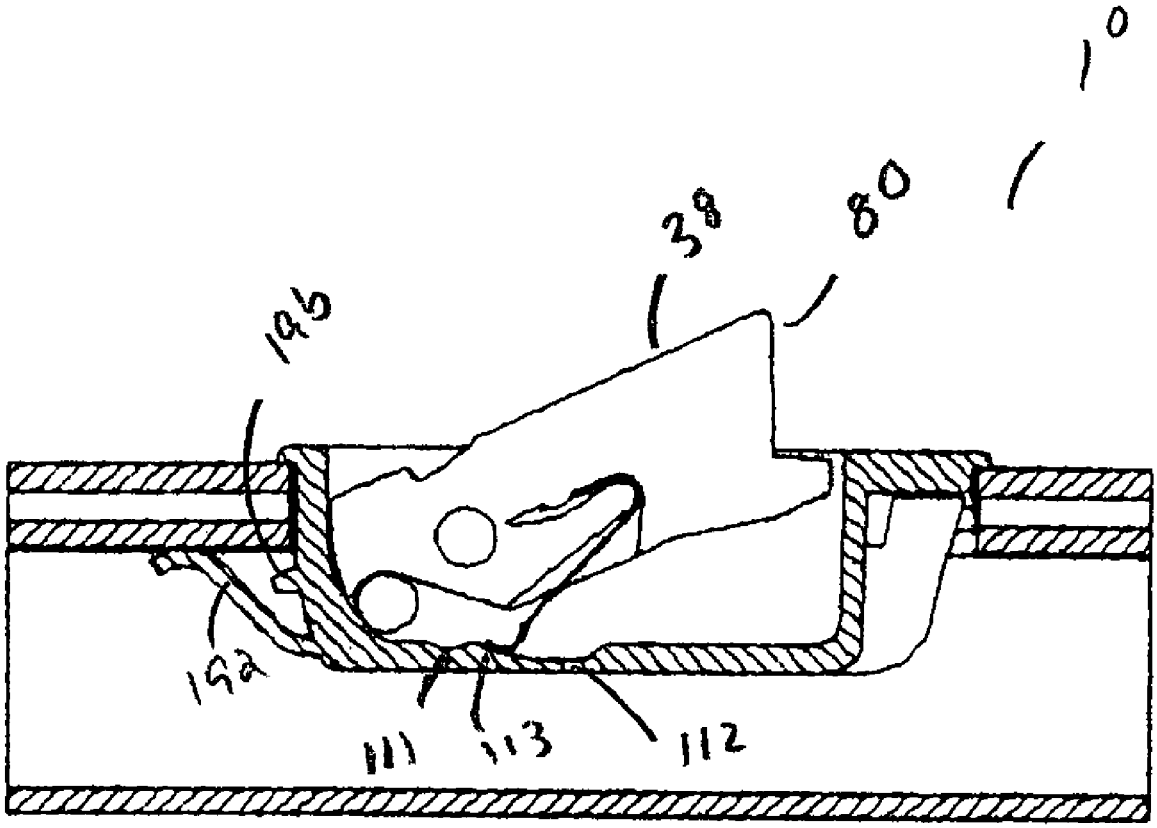
FIG. 19 is a side view of the night stop, of FIG. 14, set inside a yet another style of window frame.
Figure 20:
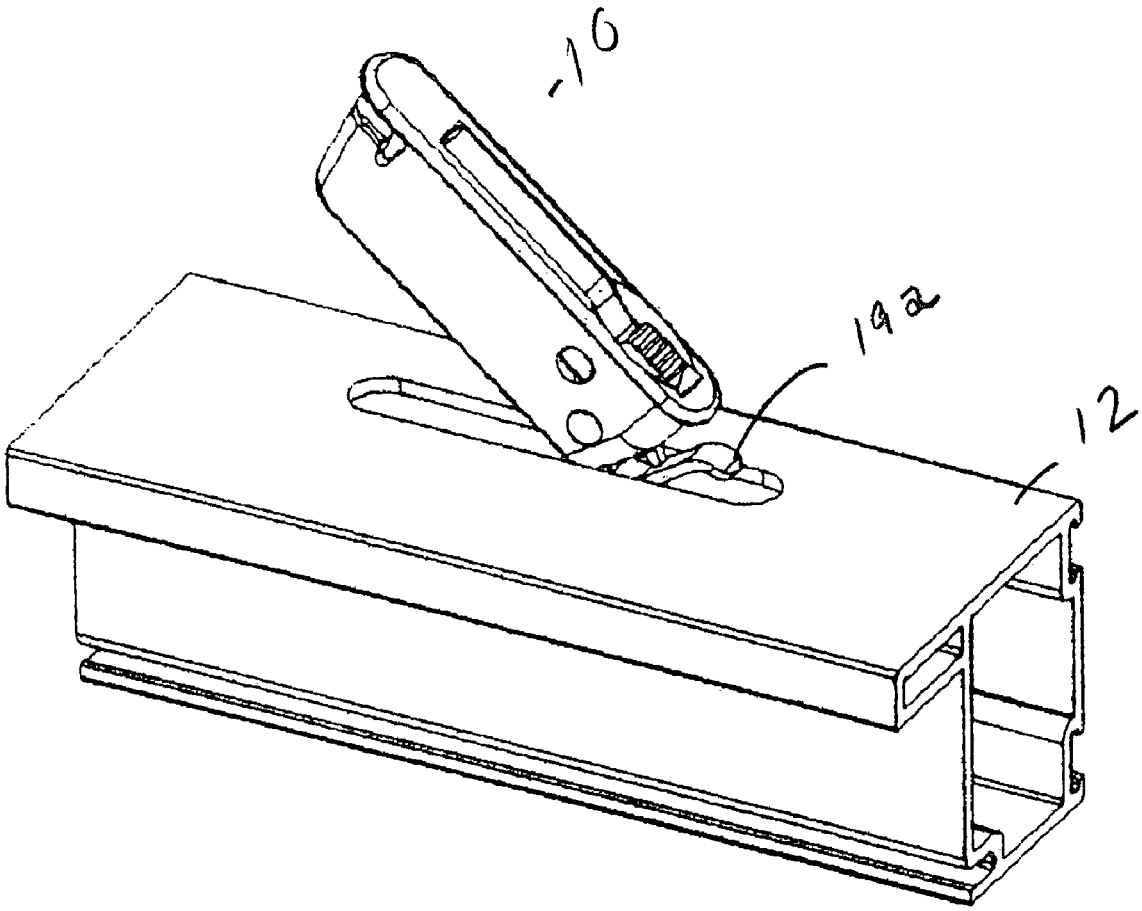
FIG. 20 is a perspective view of the night stop, of FIG. 14, being inserted into a window frame.

In another embodiment one can use a rear clip 19*a* with more flexibility than the front clip as seen in FIG. 14. It may be located at the end of the housing 13. In this embodiment the night latch of the present invention can be more compatible with different style doorframes as seen in FIG. 17 and FIG. 18. For more ease of installation, there is a raised member 19*b* protruding from side surface 17 of housing 13 as seen in FIG. 14, which ensures enough space between the clip and the housing 13. When the night latch 10 is depressed into slot 11 on a stopping member 12, the rear flexible clip 19*a* should be inserted sideling into slot 11 as seen in FIG. 20. Flexible clips 19 and 19*a* can engage a portion of the stopping member 12, as seen in FIGS. 8 and 9. This engagement can prevent vertical (front and back) movement of the night latch 10 within the stopping member 12, as well as preventing the night latch 10 from being easily dislodged from slot 11.

Figure 11:
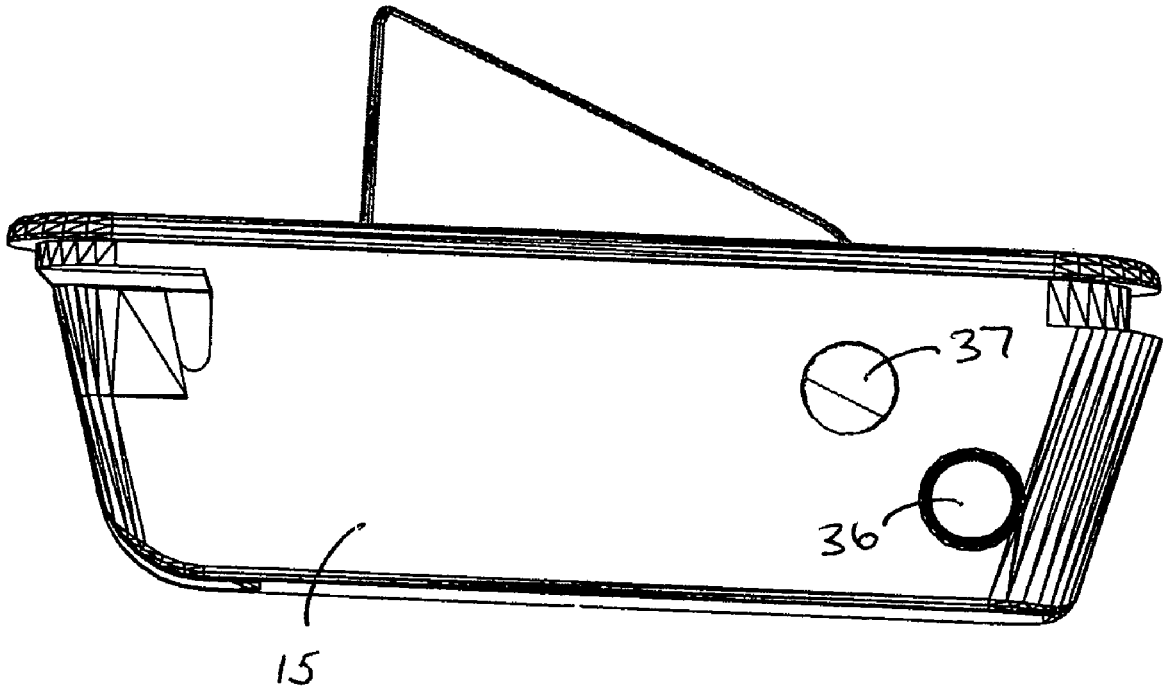
FIG. 11 is a left side view of the night stop of the present invention, with tumbler exposed.
Figure 12:
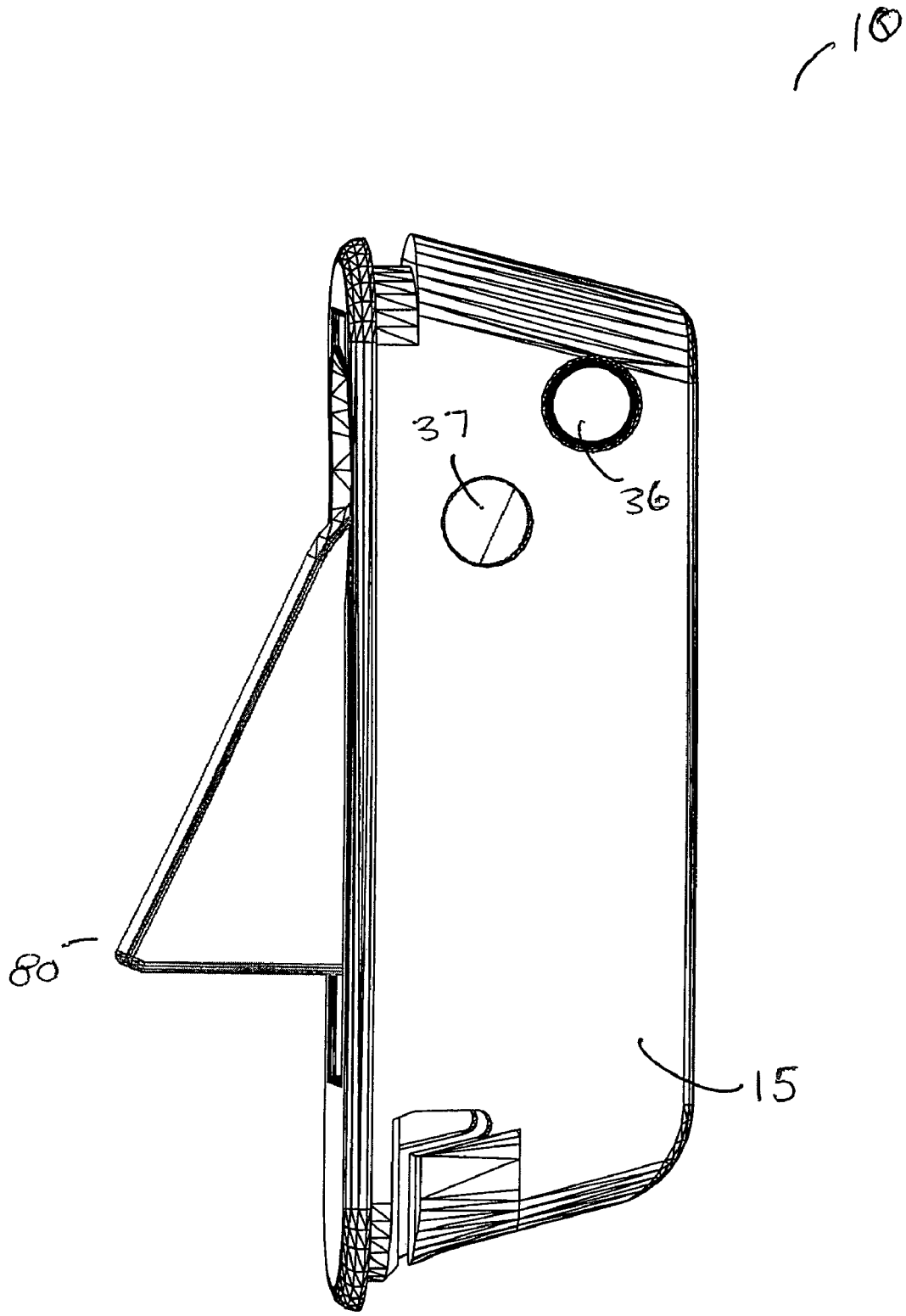
FIG. 12 is an angled view of the night stop of the present invention, with tumbler exposed.
Figure 13:
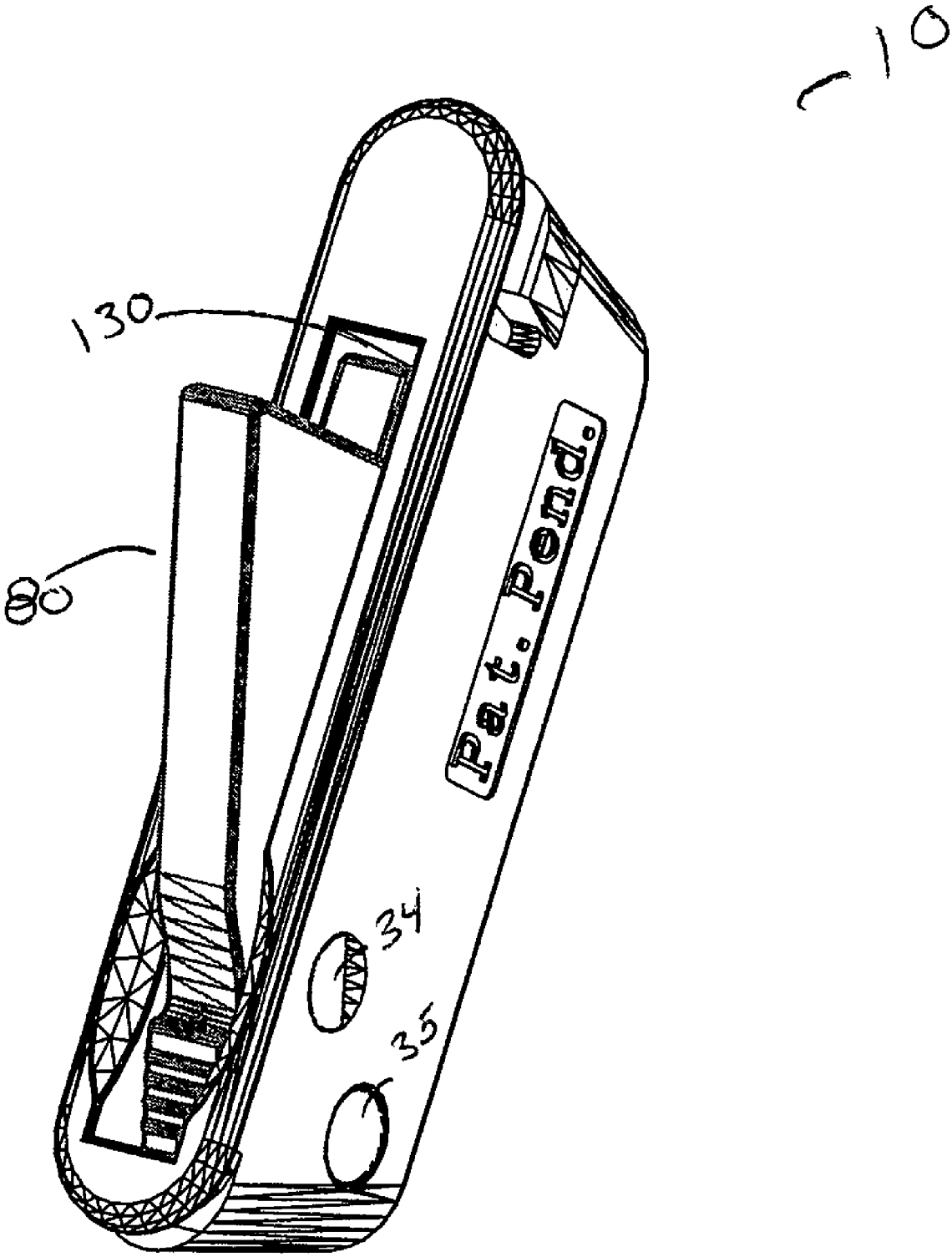
FIG. 13 is a perspective view of the night latch of the present invention, with tumbler exposed.

First sidewall 14 has an inner surface 30, not shown, and outer surface 31, as seen in FIG. 1. Second sidewall 15 has inner surface 32, not shown, and outer surface 33, not shown. On sidewalls 14 and 15 there can be four apertures, apertures 34 and 35 on sidewall 14, as seen in FIG. 1, and apertures 36 and 37 on sidewall 15, as seen in FIG. 11. Apertures 34 and 36 of sidewalls 14 and 15, respectively, are aligned along the same central axis and are positioned towards rear wall 17, and are used to prevent tumbler 80 from rotating passed a predetermined area and to support a substantial upward force associated with the lifting of the lower sash against the stopping surface of the latch. Apertures 35 and 37 of sidewalls 14 and 15, respectively, are also aligned along the same central axis; these apertures are designed so as to allow tumbler 80 to rotate in an outwardly fashion. In another embodiment one could implement bored cavities, aligned in a similar fashion, instead of apertures.

In yet another embodiment, sidewalls 14 or 15 may have at least one rotation member extending there from. In this type of embodiment tumbler 80 would have apertures or bored cavities aligned along the same central axis so as to allow tumbler 80 to rotate in an outwardly fashion.

The lip 23 attached to top plate 25 is preferably at least the same size or larger and the same general shape as slot 11. Thus, when night latch 10 is placed into slot 11, lip 23 will contact at least the edges of slot 11 or over spread the upper surface of the stopping member 12. These dimensional attributes will allow for a tight fit that will exhibit a finished smooth exterior, which can be aesthetically pleasing. Although top plate 25 is referred to as a "plate", it is understood that housing 13, clip 19, lip 23 and top plate 25 can be integral pieces, without any need for adhesives or assemblage.

In another embodiment rear clip 19*a*, attached to the rear of the housing, is preferably almost as high as the lower portion of the housing under the slot 11. Thus, when night latch 10 is placed into slot 11, clip 19*a* will contact at least the edges of slot 11 or over spread the upper surface of the stopping member 12. These dimensional attributes will allow for a tight fit that will exhibit a finished smooth exterior, which can be aesthetically pleasing. Although top plate 25 is referred to as a "plate", it is understood that housing 13, clip 19, clip 20 and top plate 25 can be integral pieces, without any need for adhesives or assemblage.

Figure 2:
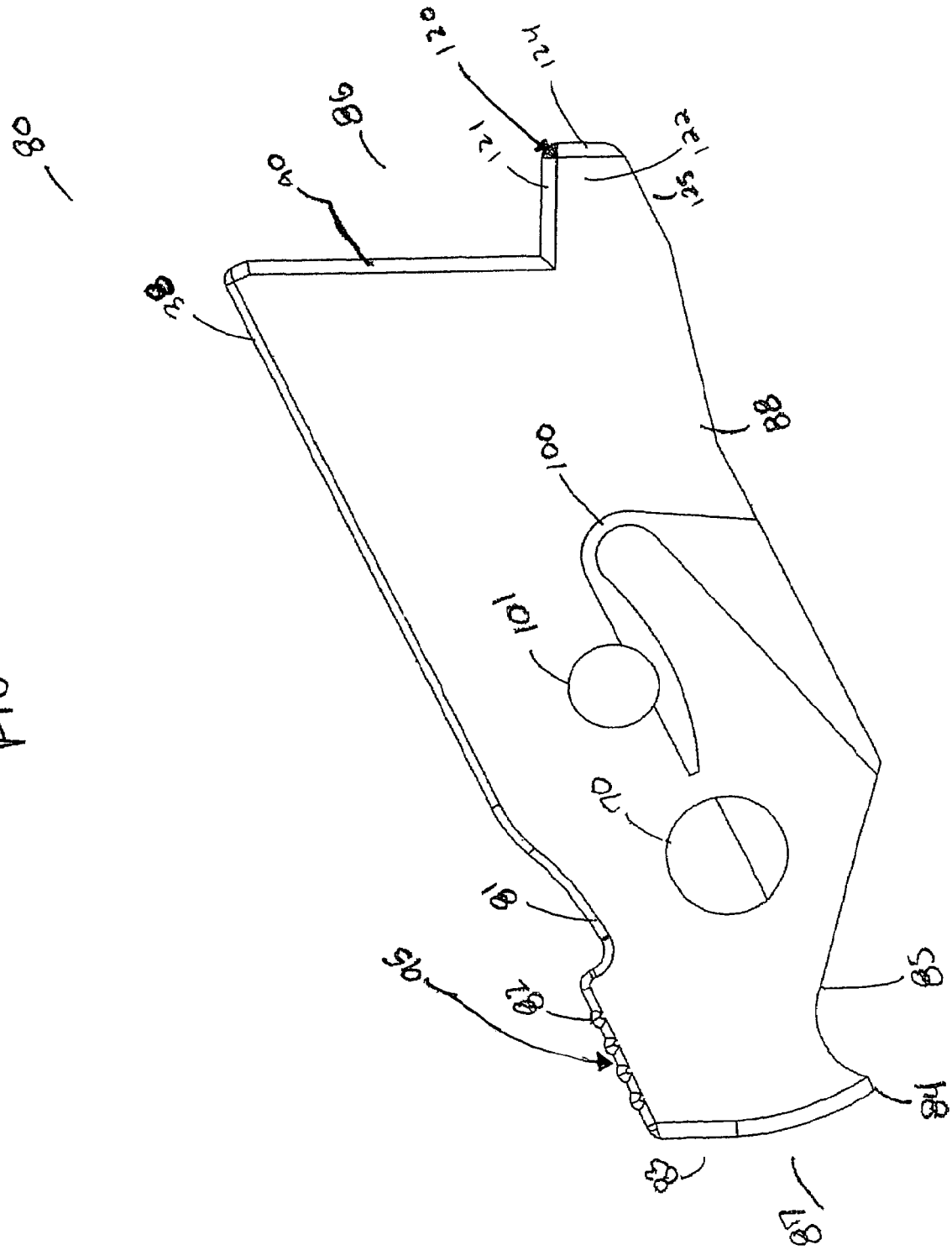
FIG. 2 is a side view of the tumbler of the present invention.
Figure 3:
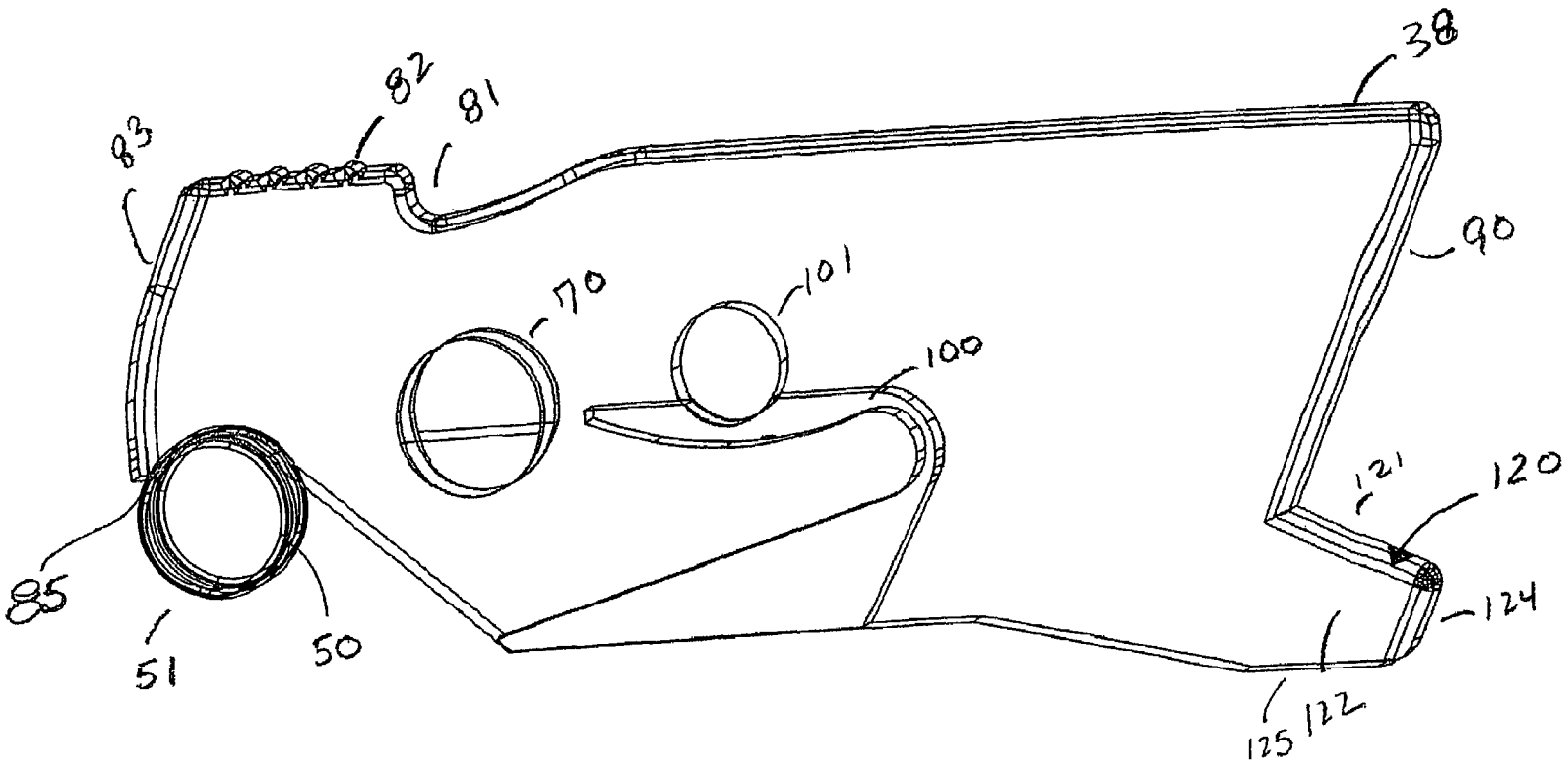
FIG. 3 is a side view of the tumbler and the stopping member of the present invention.

A tumbler 80 is preferably designed to fit within cavity 130 of housing 13, as seen in FIG. 2. Tumbler 80 may have an upper surface 38, which is preferably smooth and/or flat on the front portion, as seen in FIG. 2. A flat surface 38 will exhibit a more finished look for the night latch 10 when it is placed in stopping member 12. Tumbler 80 may have an indent 81 located toward the rear top surface. In addition tumbler 80 may have a grooved top portion 82 located right above indent 81, as in the present invention, which may act as a button 95, so as to allow the user to activate tumbler 80. The rear edge 83 of tumbler 80 slopes downward and comes to a point 84, where rear edge 83 meets arcuate bottom portion 85. Tumbler 80 can have a front end 86 and a rear end 87, along with side surfaces 88 and 89. Tumbler 80 can have rotation members 70 and 71, which can fit in apertures 35 and 37, of sidewalls 14 and 15 respectively, of housing 13. The rotation members 70 and 71 can be located on side surfaces 88 and 89, respectively, close to rear end 87. Preferably, rotation members 70 and 71 are cylindrical pegs, which protrude from side surfaces 88 and 89 of tumbler 80, respectively. The rotation members 70 and 71 can allow tumbler 80 to extend outwardly, thus exposing front end face 90 of tumbler 80, which would prevent movement of sliding member 12. The tumbler 80 will be allowed to rotate until surface 85 of tumbler 80 comes into contact with outer surface 50 of stopping member 51, as seen in FIG. 3. The stopping member may be constructed of any type of material known in the art, but not limited to plastic, metal, wood, etc., capable of withstanding the downward force of tumbler. The stopping member may be of any shape known in the art, but not limited to a cylindrical peg, a rectangular block, or a square peg. In the present embodiment a plastic cylindrical peg was implemented. In addition, stopping member, cylindrical peg 51, may be separate or an integral part of tumbler 80, in the present embodiment cylindrical peg 51 is a separate member.

Figure 4:
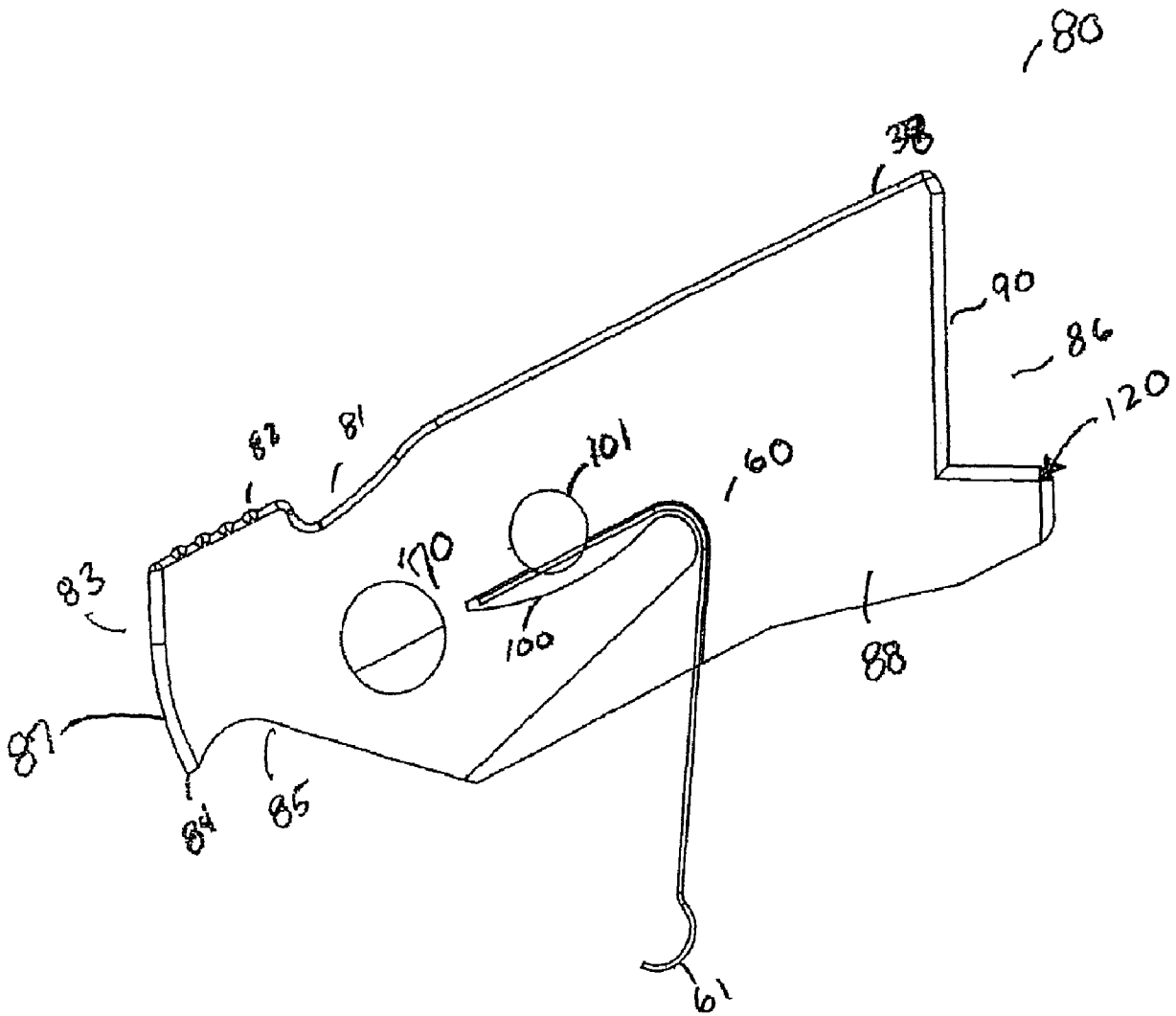
FIG. 4 is a perspective view of the tumbler and spring of the present invention.
Figure 5:
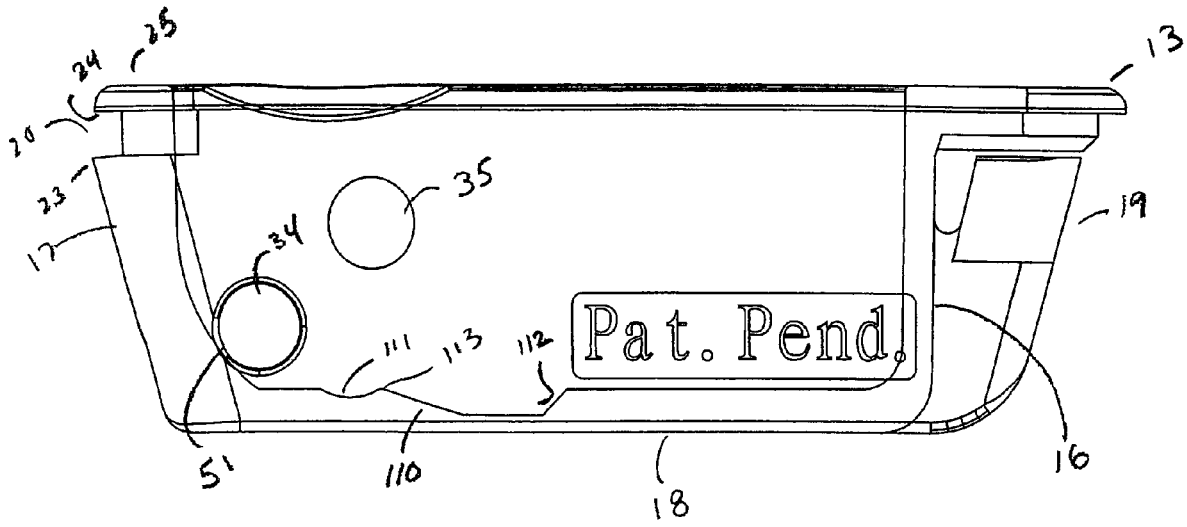
FIG. 5 is a side view of the vent stop, with the tumbler not exposed, of the present invention.
Figure 16:
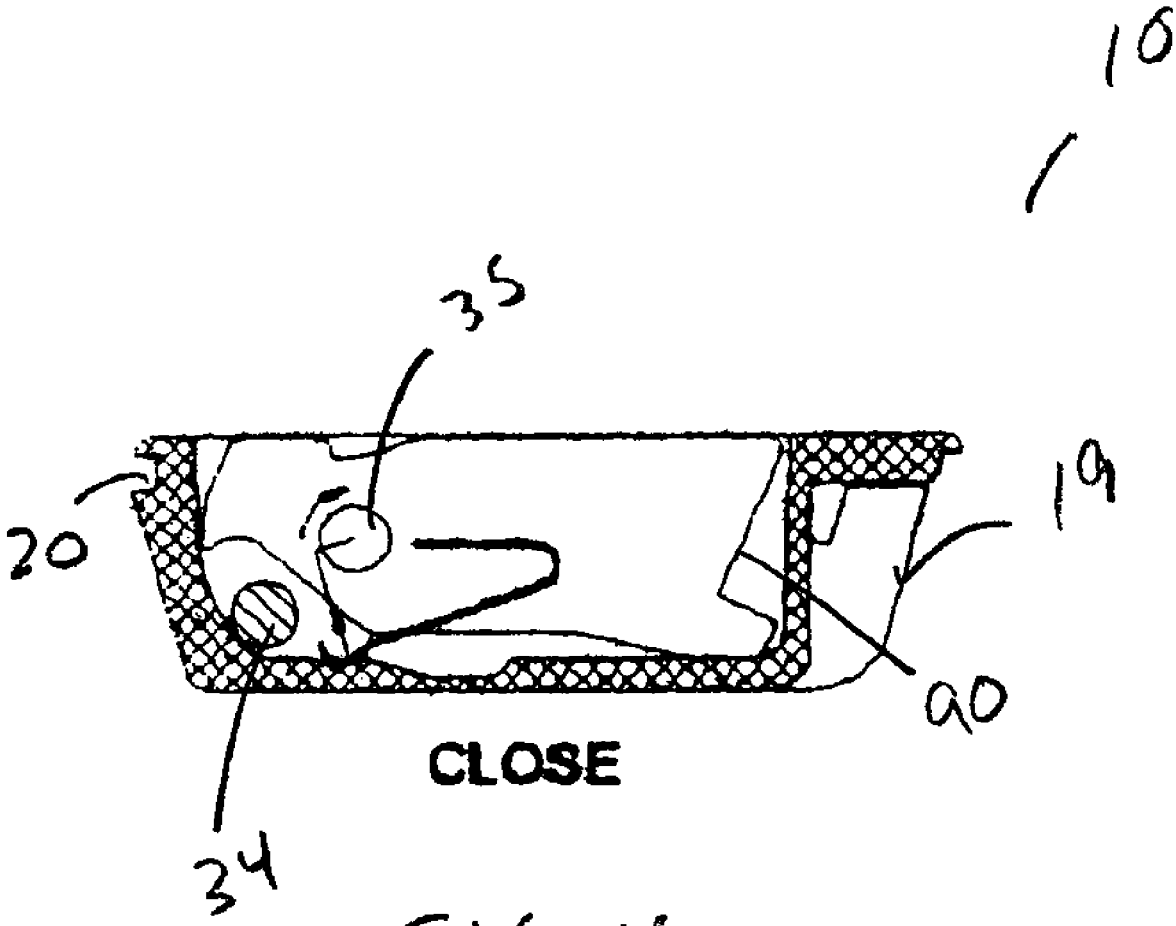
FIG. 16 is a cross sectional view of the night stop of the present invention, with the tumbler in a deactivated position.

Tumbler 80 has a cavity 100 that houses the plate spring 60, as seen in FIGS. 2 and 4. However, this is not the only possible method of attaching a spring to tumbler 80. For example, tumbler 80 can have a protruding peg on either of the side surfaces 88 or 89 that could hold the plate spring 60 in place. If this type of spring configuration is implemented, then housing 13 would have to be of such dimensions so as to allow for the additional needed space. Tumbler cavity 100 has a top and bottom surface, 47 and 48, respectively, equal in width to plate spring 60 it houses. Plate spring 60 also has a rounded bottom portion that contacts the left arcuate nest 111 and the right recession 112 in the inner bottom surface 110 of the housing 13 such that the tumbler is forced to a retracted position in the housing or an extended position out of the housing, as seen in FIGS. 16 and 17. In another embodiment rounded bottom portion 61 may be replaced by any angled shaped portion known in the art, which is capable of sliding. Inner bottom surface 110 of housing 13 has an arcuate nest 111 for cradling rounded bottom portion 61 of plate spring 60, as seen in FIG. 5. A divide point 113, where the left arcuate nest 111 meets the right recession 112, confines the bottom rounded portion 61 of plate spring 60 to be forced in different directions when the vent stop is activated or deactivated, as seen in FIG. 15. In normal operation when the user wishes to activate tumbler 80, the user will apply a downward, or inward force to button 95, this will cause rounded bottom portion 61 of plate spring 60 to move out of arcuate nest 111 and pass the divide point 113 and move into the right recession 112 of bottom surface 110 of housing 13. One must point out that arcuate nesting portion 111, divide point 113, right recession 112 of the bottom surface 110 and bottom rounded portion 61 of the plate spring 60 are of great consequence in the operation of this invention.

In addition to the tumbler cavity 100 of tumbler 80, there exists an arcuate surface 85 that interacts with an arcuate surface 50 of cylindrical peg 51. Arcuate surface 85 is preferably located on the rear bottom portion of tumbler 80. Tumbler 80 may have a protruding portion 120 located at the bottom front end wall of tumbler 80, as seen in FIG. 3. The protruding portion 120 has a top surface 121 that extends perpendicularly from the front end face 90 of the tumbler 80. The protruding portion 120 also has two sides 122, as seen in FIG. 3, and 123, not shown, a front face 124, and a bottom 125. Bottom 125 of the protruding portion 120 extends outwardly in the same direction as top surface 121 so as to meet with the outside edge of front end face 124 and is parallel to the upper surface 38 so as to come into contact with the bottom surface of back wall 110 of the housing 13 and limit further rotation of the tumbler 80 in the housing 13 when the tumbler 80 is in the retracted position, as seen in FIG. 15. The protruding portion 120 may be designed as to allow a meshing between the protruding portion 120 and the bottom surface of top plate 25, which would cause tumbler 80 from further rotating outwardly; thus if needed, protrusion 120 could be used as a limiting device.

The release of the tumbler 80 from housing 13 can be controlled by an interaction between button 95 and plate spring 60 in tumbler 80 and bottom surface 110 of the housing 13. Button 95, as mentioned previously, is located on the rear end portion of tumbler 80, can have a grooved top surface 82, which can be in the same plane as the upper surface 38 of the tumbler 80, where the user can engage button 95 easily with any suitable instrument known in the art, including but not limited to a finger, fingernail, pen, pencil etc., as seen in FIGS. 2, 3, and 4. When the user engages grooves 82, it will move rounded bottom portion 61 of plate spring 60 from a cradled position to a freed position within cavity 130 of housing 13. In the present embodiment the user applies a downward or inward force to groove 82 of tumbler 80.

When the user wishes to activate tumbler 80, so as to prevent movement of a sliding window member, the user will exert a downward, or upward force, greater than the force being exerted by the rounded bottom portion 61 of plate spring 60 against the top surface of the arcuate nesting area 111 of the bottom portion 110 of housing 13, on groove 82, of button 95. This force will cause plate spring 60 to move in a direction opposite that of the force applied by the user. When the force applied by the user has reached the critical point, it will cause the rounded bottom portion 61 of plate spring 60 to move out of equilibrium with nesting area 111 of bottom surface 110 of housing 13 and slide across divide point 113 of bottom surface 110 of housing 13 and comes in the next equilibrium with right recession 112 of bottom surface 110 of housing 13, as seen in FIGS. 15, 16 and 17. The critical point is reached when the force applied by the user overcomes the static frictional force, at which time bottom round portion 61 of plate spring 60 will begin to slide and the frictional force will drop back to a nearly constant value equal to that of the kinetic frictional force. When tumbler 80 is free to pivot on rotation members 70 and 71, the upward force of spring 60 will cause tumbler 80 to rotate in an outwardly direction until the rounded bottom portion 61 of plate spring 60 comes into contact with right recession 112 of bottom surface 110 of housing 13. In the same instance arcuate surface 85 of tumbler 80 will come in contact with arcuate surface 50 of cylindrical peg 51. In addition, a protruding portion 120 can also be implemented, so as to further limit movement of tumbler 80 by coming into contact with bottom surface of top plate 25. Once rounded bottom portion 61 of plate spring 60 has stopped sliding tumbler 80 will be exposed, thus preventing sliding window member from opening any further.

As various changes could be made in the above constructions without departing from the scope of the invention, it is intended that all matter contained in the above description shall be interpreted as illustrative and not in a limiting sense.

The operation of the night latch according to the present invention will be obvious from the above description thereof.

We claim:

1. A latch that is adapted to be set in a recess in a window or door, said latch comprising a housing, said housing having a top plate, at least two side surfaces extending from said top plate, a bottom surface extending from at least a portion of one side surface to at least a portion of the other side surface, said bottom surface of said housing having an arcuate nest and a right recession, said housing having a tumbler pivotally mounted in said housing to a circular aperture, said tumbler having recessed position where said tumbler is within the housing and an activated position wherein at least a portion of said tumbler extends from an opening in the top surface of said housing, said tumbler having an upper surface, a lower surface, a front end and a rear end, said top surface having at least a first surface portion and a second lower surface portion, and said lower surface having a first lower portion and a second lower portion, said second portion having a concave section on at least a portion thereof;

said tumbler adapted to pivot about a member that extends from at least one sidewall of said housing and which passes through an orifice in said tumbler, said tumbler being prevented from extending past said activated position by a stopping member that contacts said concave section of the lower surface of said tumbler, said tumbler having a cavity extending from said lower surface of said tumbler into said tumbler, said cavity having a first section and a second section, said first section of said cavity having one end portion of a resilient member positioned therein, said resilient member having a second end portion, said second end portion having a rounded bottom portion that contacts said arcuate nest of said bottom surface of said housing, said rounded bottom portion of said resilient member having a recessed position where said rounded bottom portion is within said arcuate nest and an activated position wherein said rounded bottom portion is within said right recession of said bottom surface of said housing.

2. The latch according to claim 1, wherein said stopping member extends from at least one sidewall of said housing.

3. The latch according to claim 2, wherein said stopping member extends from one sidewall of said housing to the other sidewall of said housing.

4. The latch according to claim 3, wherein said stopping member is a removable pin that passes through an orifice in at least one sidewall of said housing.

5. The latch according to claim 4, wherein said stopping member is a removable pin that passes through an orifice in both sidewalls of said housing.

6. The latch according to claim 5, wherein said tumbler has a protrusion extending from a front end of said tumbler, said protrusion contacting a portion of the bottom surface of said top plate of said housing when said tumbler is in an activated position.

7. The latch according to claim 5, wherein said tumbler has a protrusion extending from a front end of said tumbler, said protrusion contacting a portion of the bottom surface of said top plate top surface of said housing when said tumbler is in an activated position.

8. The latch according to claim 3, wherein said stopping member is a removable pin that passes through an orifice in at least one sidewall of said housing.

9. The latch according to claim 2, wherein said stopping member extends from one sidewall of said housing to the other sidewall of said housing.

10. The latch according to claim 1, wherein said stopping member extends from at least one sidewall of said housing.

11. The latch according to claim 1, wherein said tumbler is adapted to move from a recessed position to an activated position by applying a force to said second surface portion of said tumbler.

12. The latch according to claim 11, wherein said resilient member is a plate spring, wherein said plate spring acts as a biased means that can force said tumbler in both a retracted and extended position.

13. The latch according to claim 12, wherein said second end of said resilient member has a generally "u" shaped tip.

14. The latch according to claim 13, wherein said "u" shaped tip has a top surface and a bottom surface, and wherein said bottom surface of said tip contacts the inside surface of said bottom surface of said housing when said tumbler is in a recessed position.

15. The latch according to claim 13, wherein said "u" shaped tip is positioned in a nesting area on said inside surface of said bottom surface of said housing when said tumbler is in a recessed position.

16. The latch assembly according to claim 15, wherein said "u" shaped tip is moved from said nesting area when a force is placed on said second surface portion of said tumbler.

17. A latch that is adapted to be set in a recess in a window or door, said latch comprising a housing, said housing having a top surface, at least two side surfaces extending from said top surface, and a bottom surface extending from at least a portion of one side surface to at least a portion of the other side surface, said bottom surface of said housing having an arcuate nest and a right recession, said housing having a tumbler pivotally mounted in said housing said tumbler having recessed position where said tumbler is within the housing and an activated position wherein at least a portion of said tumbler extends from an opening in the top surface of said housing, said tumbler having an upper surface, a lower surface, a front end and a rear end, said top surface having at least a first surface portion and a second lower surface portion, and said lower surface having a first lower portion and a second lower portion, said second portion having a concave section on at least a portion thereof;

said tumbler adapted to pivot about a member that extends from at least one sidewall of said tumbler and which passes through an orifice in said sidewall of said housing, said tumbler being prevented from extending past said activated position by a stopping member that contacts said concave section of the lower surface of said tumbler, said tumbler having a cavity extending from said lower surface of said tumbler into said tumbler, said cavity having a first section and a second section, said first section of said cavity having one end portion of a resilient member positioned therein, said resilient member having a second end portion, said second end portion having a rounded bottom portion that contacts said arcuate nest of said bottom surface of said housing, said rounded bottom portion of said resilient member having a recessed position where said rounded bottom portion is within said arcuate nest and an activated position wherein said rounded bottom portion is within said right recession of said bottom surface of said housing.

18. The latch according to claim 17, wherein said tumbler is adapted to move from a recessed position to an activated position by applying a force to said second surface portion of said tumbler, said second surface portion being adjacent to said rear end of said tumbler.

19. A latch that is adapted to be set in a recess in a window or door, said latch comprising a housing, said housing having a top surface, at least two side surfaces extending from said top surface, and a bottom surface extending from one side surface to the other side surface, said bottom surface of said housing having an arcuate nest and a right recession, said housing having a tumbler pivotally mounted in said housing, said tumbler having recessed position where said tumbler is within the housing and an activated position wherein a portion of said tumbler extends from an opening in the top surface of said housing, said tumbler having an upper surface, a lower surface, a front end and a rear end, said tumbler having a cavity extending from said lower surface of said tumbler into said tumbler, said cavity having a first section and a second section, said first section of said cavity having one end portion of a resilient member positioned therein, said resilient member having a second end portion, said second end portion having a rounded bottom portion that contacts said arcuate nest of said bottom surface of said housing, said rounded bottom portion of said resilient member having a recessed position where said rounded bottom portion is within said arcuate nest and an activated position wherein said rounded bottom portion is within said right recession of said bottom surface of said housing.

20. The latch according to claim 19, wherein said second end portion of said resilient member is in a first position when said tumbler is in a recessed position and a second position when said tumbler is in an activated position.

21. The latch according to claim 20, wherein one side of said resilient member contacts one wall of said second section of said cavity when said tumbler is in a recessed position and a second side of said resilient member contacts second wall of said cavity when said tumbler is in an activated position.

22. The latch according to claim 19, wherein said resilient member is retained in said tumbler by said first section of said cavity.

23. The latch according to claim 19, wherein said first section of said cavity has a top surface and a bottom surface, said bottom surface being slightly concave to help prevent said resilient member from sliding out of said cavity.

24. A latch that is adapted to be set in a recess in a window or door, said latch comprising a housing, said housing having a top plate, at least two side surfaces extending from said top plate, and a bottom surface extending from at least a portion of one side surface to at least a portion of the other side surface, said bottom surface of said housing having an arcuate nest and a right recession, said housing having a tumbler pivotally mounted in said housing said tumbler having recessed position where said tumbler is within the housing and an activated position wherein at least a portion of said tumbler extends from an opening in the top surface of said housing, said tumbler having a first face and a second face and an upper edge a lower edge, a front end and a rear edge, said first face and said second face being joined by said edges, said top edge having at least a first surface portion and a second surface portion, said second edge being adjacent near end of said tumbler and said lower surface having a first lower portion and a second lower portion, said second portion having a concave section on at least a portion thereof;

said tumbler adapted to pivot about a member that extends from at least one sidewall of said housing and which passes through an orifice in said tumbler, said tumbler being prevented from extending past said activated position by a stopping member that contacts said concave section of the lower edge of said tumbler, said tumbler being capable of moving from a recessed position to an activated position by the application of force to said second surface portion of said tumbler, said tumbler having a cavity extending from said lower surface of said tumbler into said tumbler, said cavity having a first section and a second section, said first section of said cavity having one end portion of a resilient member positioned therein, said resilient member having a second end portion, said second end portion having a rounded bottom portion that contacts said arcuate nest of said bottom surface of said housing, said rounded bottom portion of said resilient member having a recessed position where said rounded bottom portion is within said arcuate nest and an activated position wherein said rounded bottom portion is within said right recession of said bottom surface of said housing.

25. A latch that is adapted to be set in a recess in a window or door, said latch comprising a housing, said housing having a top plate, at least two side plate extending from said top surface, and a bottom surface extending from at least a portion of one side surface to at least a portion of the other side surface, said surface of said housing having an arcuate nest and a right recession, said housing having a tumbler pivotally mounted in said housing said tumbler having recessed position where said tumbler is within the housing and an activated position wherein at least a portion of said tumbler extends from an opening in the top surface of said housing, said tumbler having a first face and a second face and an upper edge a lower edge, a front end and a rear edge, said first face and said second face being joined by said edges, said top edge having at least a first surface portion and a second surface portion, said second edge being adjacent near end of said tumbler and said lower surface having a first lower portion and a second lower portion, said second portion having a concave section on at least a portion thereof;

said tumbler adapted to pivot about a member that extends from at least one sidewall of said tumbler and which passes through an orifice in said sidewall of said housing, said tumbler being prevented from extending past said activated position by a stopping member that contacts said concave section of the lower edge of said tumbler, said tumbler being capable of moving from a recessed position to an activated position by the application of force to said second surface portion of said tumbler, said tumbler having a cavity extending from said lower surface of said tumbler into said tumbler, said cavity having a first section and a second section, said first section of said cavity having one end portion of a resilient member positioned therein, said resilient member having a second end portion, said second end portion having a rounded bottom portion that contacts said arcuate nest of said bottom surface of said housing, said rounded bottom portion of said resilient member having a recessed position where said rounded bottom portion is within said arcuate nest and an activated position wherein said rounded bottom portion is within said right recession of said bottom surface of said housing.

* * * * *